US012527406B2

(12) United States Patent
Pittman

(10) Patent No.: US 12,527,406 B2
(45) Date of Patent: Jan. 20, 2026

(54) INFLATABLE MATTRESS FOR USE IN A VEHICLE

(71) Applicant: James J. Pittman, Yorba Linda, CA (US)

(72) Inventor: James J. Pittman, Yorba Linda, CA (US)

( * ) Notice: Subject to any disclaimer, the term of this patent is extended or adjusted under 35 U.S.C. 154(b) by 175 days.

(21) Appl. No.: 18/369,595

(22) Filed: Sep. 18, 2023

(65) Prior Publication Data

US 2025/0089903 A1 Mar. 20, 2025

(51) Int. Cl.

*A47C 17/80* (2006.01)
*A47C 27/08* (2006.01)
*A47C 27/10* (2006.01)

(52) U.S. Cl.

CPC ..... *A47C 17/80* (2013.01); *A47C 27/082* (2013.01); *A47C 27/10* (2013.01)

(58) Field of Classification Search

CPC ..... A47C 17/80; A47C 27/081; A47C 27/082; A47C 27/083; A47C 27/084; A47C 27/10
See application file for complete search history.

(56) References Cited

U.S. PATENT DOCUMENTS 3,648,306 A * 3/1972 Auerbach ..... B60N 2/2854 5/118
3,696,449 A * 10/1972 Smith ..... A47D 13/063 5/118
3,902,759 A * 9/1975 Monteforte ..... A47C 17/045 5/12.1
4,078,842 A * 3/1978 Zur ..... A47C 7/021 297/284.6
4,153,958 A * 5/1979 Paulik ..... A47C 4/52 5/12.1
4,394,784 A * 7/1983 Swenson ..... A47C 27/082 415/206
4,459,714 A * 7/1984 Lin ..... A47C 27/081 24/DIG. 42
4,964,183 A * 10/1990 LaForce, Jr. ..... A47C 1/14 4/588
D407,937 S * 4/1999 Klimenko ..... D6/601
6,042,186 A * 3/2000 Kojic ..... A47C 4/54 5/59.1

(Continued)

FOREIGN PATENT DOCUMENTS

CN 2696410 Y * 5/2005 ..... A47C 15/006
CN 216907431 U * 7/2022 ..... A47C 17/80

(Continued)

*Primary Examiner* — David E Sosnowski
(74) *Attorney, Agent, or Firm* — Barcelo, Harrison & Walker, LLP; Joshua C. Harrison, Esq.

(57) ABSTRACT

An inflatable mattress for use in a vehicle is disclosed and claimed. The inflatable mattress may include a removable air pump, and a first longitudinal chamber that may include a pump cavity that receives and stores the removable air pump. The pump cavity may include a first inlet that is adapted to mate with an outlet of the removable air pump within the cavity for ready inflation of the first longitudinal chamber without removal of the air pump from the cavity. The inflatable mattress may further include a second independently-inflatable longitudinal chamber having a second inlet for mating with the outlet of the removable air pump at a second inlet location that is disposed outside of the cavity.

20 Claims, 11 Drawing Sheets

(56) References Cited

U.S. PATENT DOCUMENTS 7,131,701 B1 * 11/2006 Yang ..... A47C 4/54 297/452.41
9,144,318 B1 * 9/2015 Lagier ..... A47C 3/16
D851,962 S * 6/2019 King ..... D6/604
D852,543 S * 7/2019 Clute ..... D6/604
D861,378 S * 10/2019 Pally ..... D6/604
D934,595 S * 11/2021 King ..... D6/604
11,517,121 B2 * 12/2022 Boyd ..... A47C 27/082
11,612,255 B1 * 3/2023 Ducato ..... B60N 3/008 5/118
11,698,075 B2 * 7/2023 Huang ..... F04D 25/084 5/713
D1,002,214 S * 10/2023 Qiao ..... D6/381
11,807,146 B1 * 11/2023 Ducato ..... A47C 17/80
11,959,301 B2 * 4/2024 Ramos ..... E04H 4/14
D1,033,993 S * 7/2024 Li ..... D6/604
D1,033,994 S * 7/2024 Li ..... D6/604
D1,063,446 S * 2/2025 Ducato ..... D6/604
D1,066,955 S * 3/2025 Li ..... D6/604
2005/0076437 A1 * 4/2005 Johnson ..... B60P 7/16 5/81.1 R
2005/0099054 A1 * 5/2005 Mccarthy ..... A47C 17/045 297/452.41
2005/0102751 A1 * 5/2005 Kang ..... B62D 33/0612 5/118
2008/0289102 A1 * 11/2008 Davis ..... A61G 7/0504 5/81.1 R
2009/0019638 A1 * 1/2009 Ellis ..... A47C 27/082 5/119
2009/0144904 A1 * 6/2009 Moye ..... A61G 7/05769 5/620
2010/0229298 A1 * 9/2010 Davis ..... A47C 20/021 5/81.1 R
2010/0235988 A1 * 9/2010 Pittman ..... A47C 21/048 5/119
2011/0225731 A1 * 9/2011 Hanrahan ..... B60P 3/38 5/118
2011/0225739 A1 * 9/2011 Hanrahan ..... A47C 27/082 5/709
2012/0036645 A1 * 2/2012 Wang ..... A47C 27/083 5/706
2013/0061399 A1 * 3/2013 Dewell ..... A47C 27/10 5/713
2013/0180052 A1 * 7/2013 Chen ..... A47C 27/082 5/711
2020/0164779 A1 * 5/2020 Bosstick ..... B60N 2/60
2023/0309701 A1 * 10/2023 Shi ..... A47C 27/10 5/119
2025/0107637 A1 * 4/2025 Ravalier ..... A47C 27/082

FOREIGN PATENT DOCUMENTS

DE 102008034983 A1 * 1/2010 ..... B60P 3/38
EP 0945090 A2 * 9/1999 ..... A47C 27/20
GB 2510849 A * 8/2014 ..... B60P 3/34

* cited by examiner

INFLATABLE MATTRESS FOR USE IN A VEHICLE

FIELD OF THE INVENTION

The present invention relates to inflatable mattresses designed for use in vehicles.

BACKGROUND

Inflatable mattresses have been used in houses, tents, campers, RVs, truck beds, vans, and other vehicles. Some such inflatable mattresses are sized to accommodate two adults, and such mattresses can unnecessarily occupy excessive space in some vehicles with a single traveler. Certain inflatable mattresses that have more than one separate internal chamber may be inconvenient or excessively time consuming to inflate. Certain vehicles may have not have flat cargo spaces that can evenly support an air mattress, leading to sleep discomfort. Some inflatable mattress products may be unprofitable because of unnecessary complexity that adversely affects manufacturability and cost. Thus, there is a need in the art for an improved mattress design for use in vehicles.

SUMMARY OF DISCLOSURE

An inflatable mattress for use in a vehicle is disclosed and claimed. The inflatable mattress may include a removable air pump that may optionally be battery-powered, and a first longitudinal chamber that may include a pump cavity that receives and stores the removable air pump. The pump cavity may have a first inlet that is adapted to mate with an outlet of the removable air pump within the cavity for ready inflation of the first longitudinal chamber without removal of the air pump from the cavity. The inflatable mattress may further include a second independently-inflatable longitudinal chamber having a second inlet for mating with the outlet of the removable air pump at a second inlet location that is disposed outside of the cavity.

DESCRIPTION OF THE EXEMPLARY EMBODIMENTS

Figure 1:
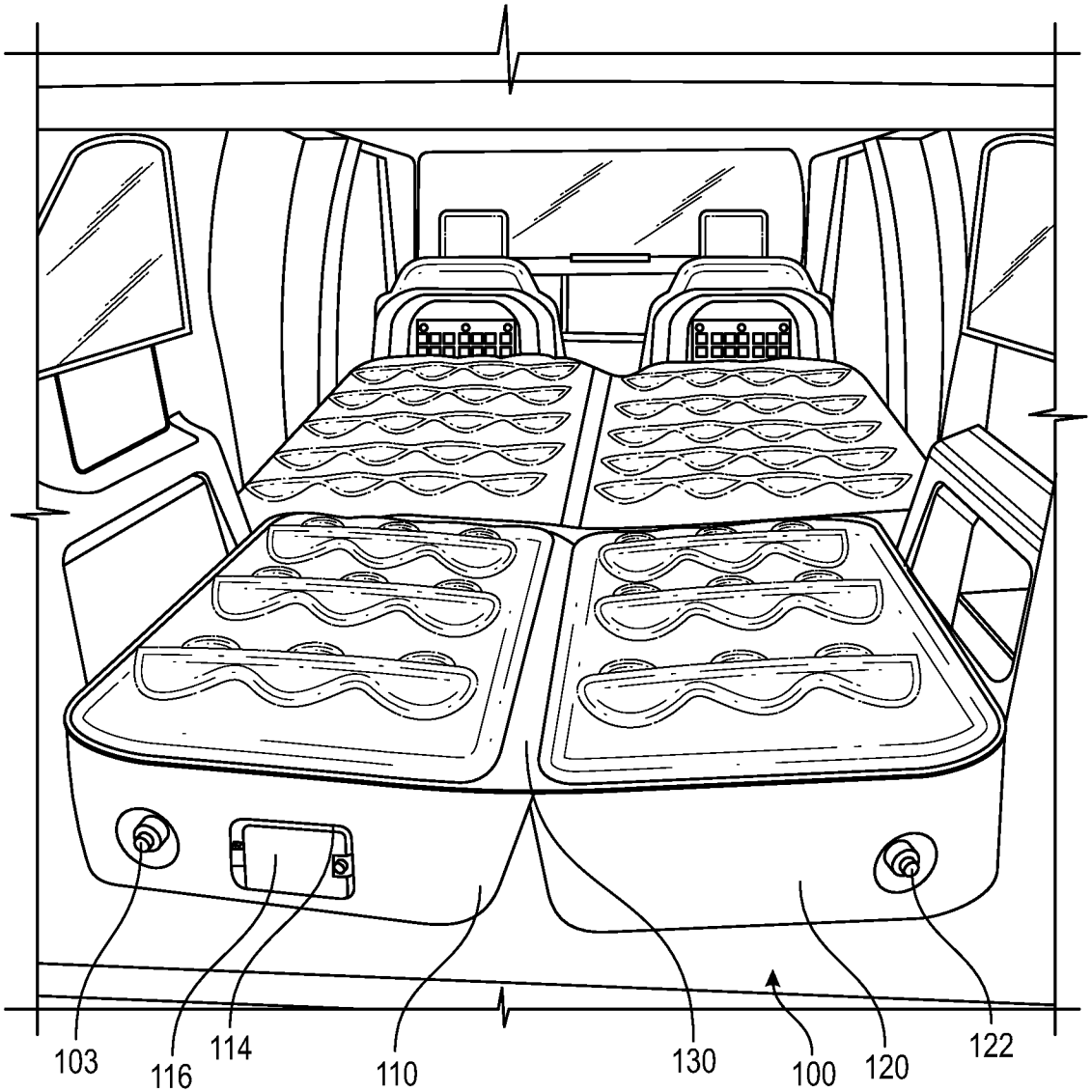
FIG. 1 depicts an inflatable mattress according to an exemplary embodiment of the present invention, shown as positioned within the rear interior space of a vehicle for usage context.
Figure 2:
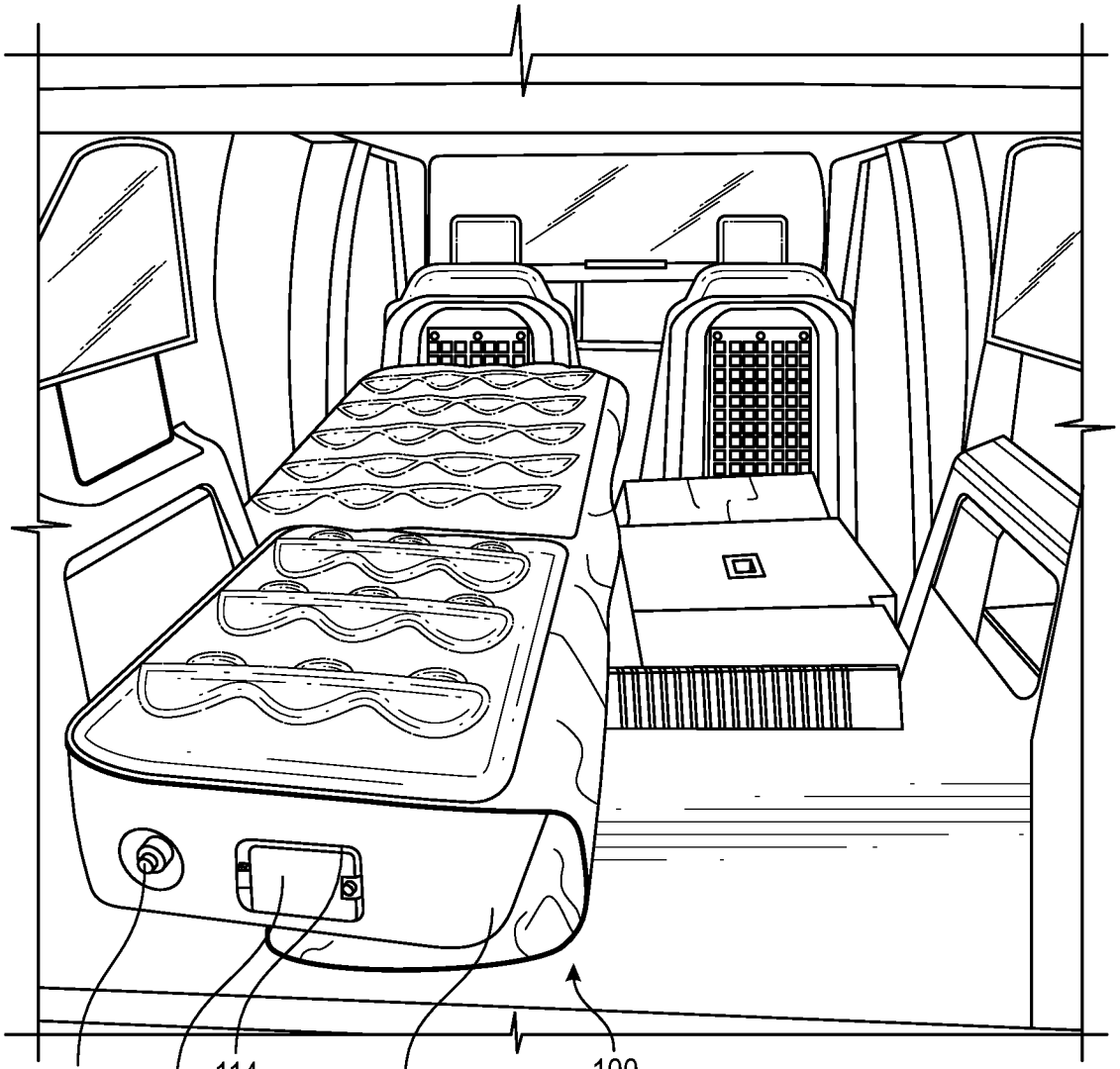
FIG. 2 depicts the inflatable mattress of FIG. 1 with a longitudinal chamber optionally left deflated.

FIG. 1 depicts an inflatable mattress 100 according to an exemplary embodiment of the present invention, shown as positioned within the rear interior space of a vehicle for usage context. The vehicle shown is optionally but not necessarily a sport utility vehicle. For convenience, the term "sport utility vehicle" as used herein also includes so-called "crossover" vehicles, station wagons, and other vehicles having similar interior spaces. It is also contemplated herein that a mattress according to an exemplary embodiment of the present invention may also be used in other types of vehicles, e.g. vans, trucks, RVs, campers, etc. Regardless, the claims of this patent application are directed to an inflatable mattress and its components as specified in the claims, and do not cover any vehicle for which the inflatable mattress may be designed for use, or any vehicle, house, or tent in which inflatable mattress may ultimately be used. FIG. 2 depicts the exemplary inflatable mattress 100 with a longitudinal chamber optionally left deflated.

Now referring to FIGS. 1 and 2, the exemplary inflatable mattress 100 includes a first longitudinal chamber 110 that includes a cavity 114 that receives and stores a removable air pump (obscured by cavity door 116 in the views of FIGS. 1 and 2) at the aft end of the inflatable mattress 100. The removable air pump is operable to inflate the first longitudinal chamber 110 in place, without being removed, through a first internal inlet (also obscured in the views of FIGS. 1 and 2). The term "inlet" as used herein corresponds to a port that can be used as an inlet for inflation, but does not exclude ports that can also be used as outlets for deflation.

The exemplary inflatable mattress 100 further includes a second longitudinal chamber 120 that is independently inflatable or deflatable via a second inlet 122 in the aft end of the inflatable mattress 100. The second inlet 122 is disposed outside of the cavity 114, and that is configured to mate with the removable air pump outside of the cavity 114 for optional inflation (if the user chooses to optionally utilize the second longitudinal chamber 120).

In the embodiment of FIGS. 1 and 2, the first longitudinal chamber 110 optionally further comprises an auxiliary inlet 103 to provide the option of inflating and deflating the first longitudinal chamber 110 without use of the removable air pump within the cavity 114. Although the cavity 114 and the second inlet 122 are preferably disposed at the aft end of the inflatable mattress 100 in this exemplary embodiment, it is contemplated that they could instead optionally be located on other sides or faces of the mattress.

In the exemplary embodiment of FIG. 1, the first and second longitudinal chambers 110, 120 are shown to be joined along a flexible longitudinal seam 130 that is disposed between them and optionally extends laterally from their top surfaces. For example, the flexible longitudinal seam 130 may comprise a fabric bridge (e.g., rip-stop nylon, canvass, etc.) that may optionally but not necessarily be the same material as that which covers the top surfaces of the first and second longitudinal chambers 110, 120.

Figure 3:
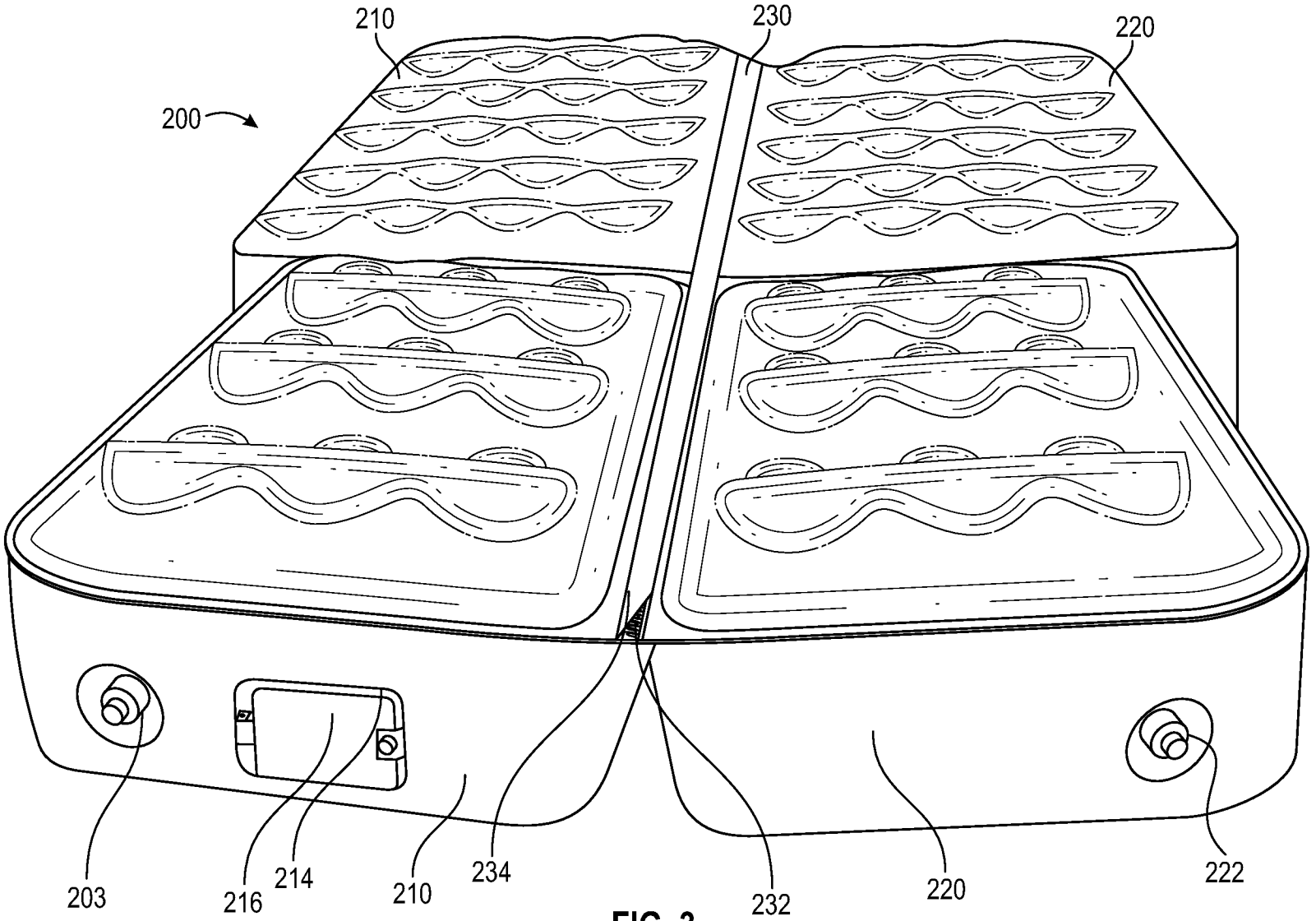
FIG. 3 depicts an inflatable mattress according to another exemplary embodiment of the present invention.

FIG. 3 depicts an inflatable mattress 200 according to another exemplary embodiment of the present invention. The exemplary inflatable mattress 200 includes a first longitudinal chamber 210 that includes a cavity 214 that receives and stores a removable air pump (obscured by cavity door 216 in the view of FIG. 3) that is operable to inflate the first longitudinal chamber 210 in place, without being removed, through a first internal inlet (also obscured in the views of FIG. 3).

The exemplary inflatable mattress 200 further includes a second longitudinal chamber 220 that is independently inflatable or deflatable via a second inlet 222 disposed outside of the cavity 214, and that is configured to mate with the removable air pump outside of the cavity 214 for optional inflation (if the user chooses to optionally utilize the second longitudinal chamber 220). In the embodiment of FIG. 3, the first longitudinal chamber 210 optionally further comprises an auxiliary inlet 203 to provide the option of inflating and deflating the first longitudinal chamber 210 without use of the removable air pump within the cavity 214.

In certain embodiments, the inflatable mattress 200 may be sized to fit within a rear interior space of a sport utility vehicle. In such embodiments, each of the first and second longitudinal chambers 210, 220 may preferably have a length in the range 65 to 80 inches, and a width in the range 40 to 60 inches. In certain embodiments, the width of the first longitudinal chamber 210 optionally may be equal to the width of the second longitudinal chamber 220 (e.g., 24 to 28 inches), as shown in FIG. 3. However, it is contemplated that in certain alternative embodiments, the width of the first longitudinal chamber 210 may instead be greater than the width of the second longitudinal chamber 220 by a width difference in the range of 10 to 14 inches. Such an alternative might be adopted, for example, to enable the first longitudinal chamber 210 to be more comfortable than the second longitudinal chamber 220, in applications where it is expected that the second longitudinal chamber 220 is to be substantially less frequently inflated and used.

In the exemplary embodiment of FIG. 3, the first and second longitudinal chambers 210, 220 are shown to be joined along a flexible longitudinal seam 230 that is disposed between them and optionally extends from their top surfaces. For example, the flexible longitudinal seam 230 may include a longitudinal zipper 232 that may be used to selectively joined or separate the first and second longitudinal chambers 210, 220. As shown in FIG. 3, the longitudinal zipper 232 may include a top cover 234 (e.g., a fabric flap to protect the longitudinal zipper 232 from debris or to protect a mattress user from discomfort from direct contact with the longitudinal zipper 232).

Figure 4A:
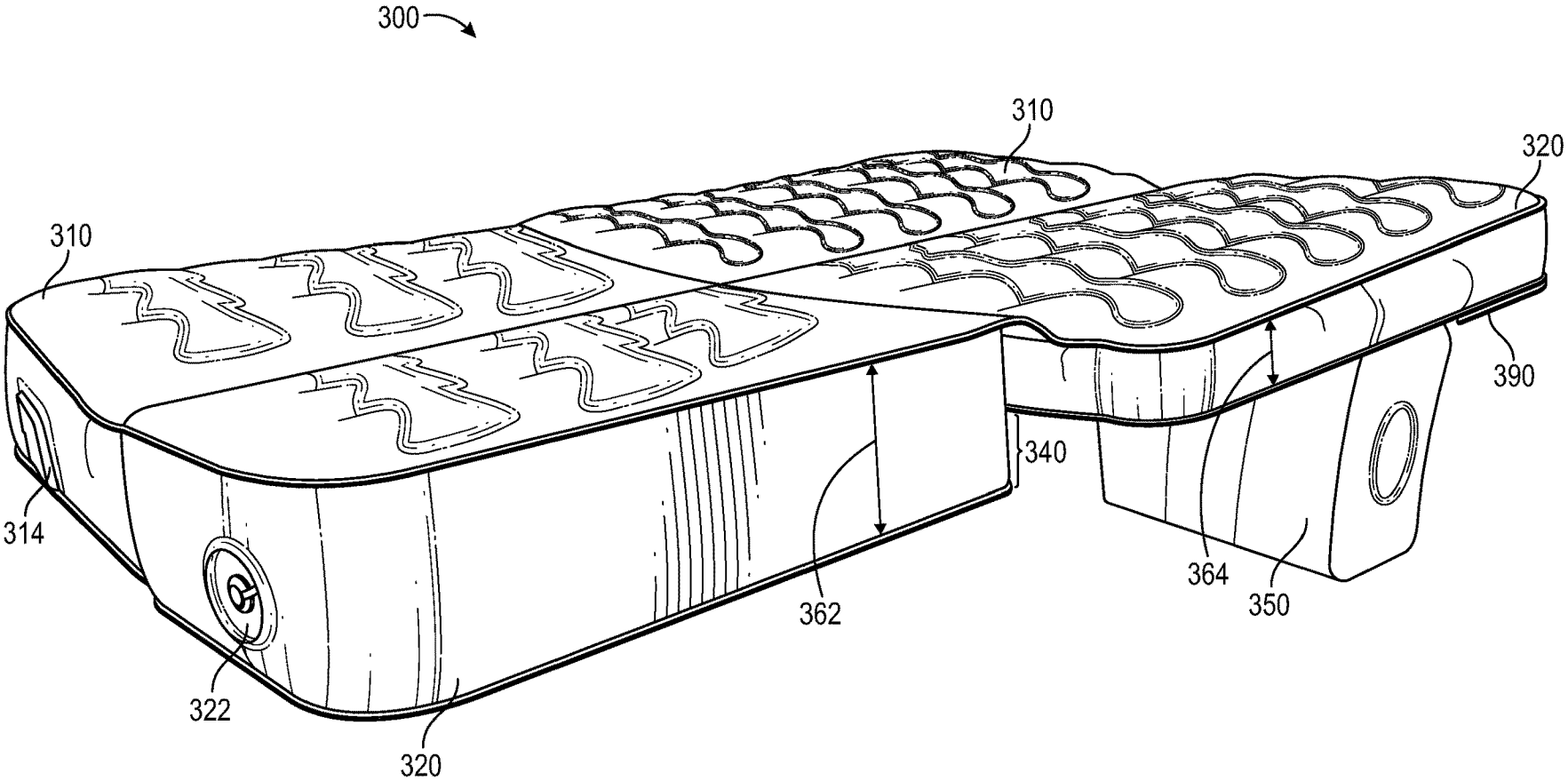
FIG. 4A depicts an inflatable mattress according to another exemplary embodiment of the present invention.
Figure 4B:
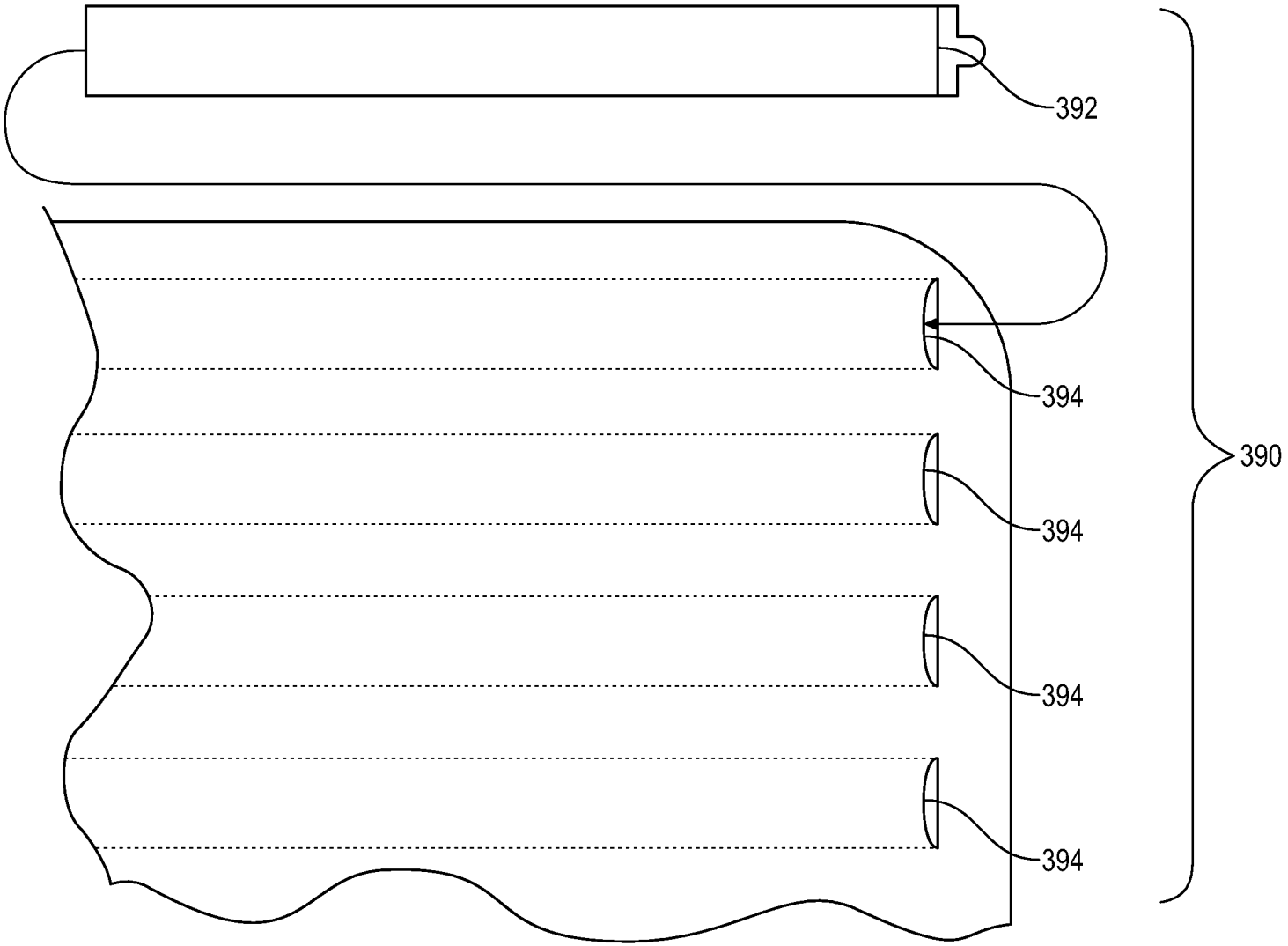
FIG. 4B is an underside view of a leading corner region of the inflatable mattress of FIG. 4A.
Figure 5:
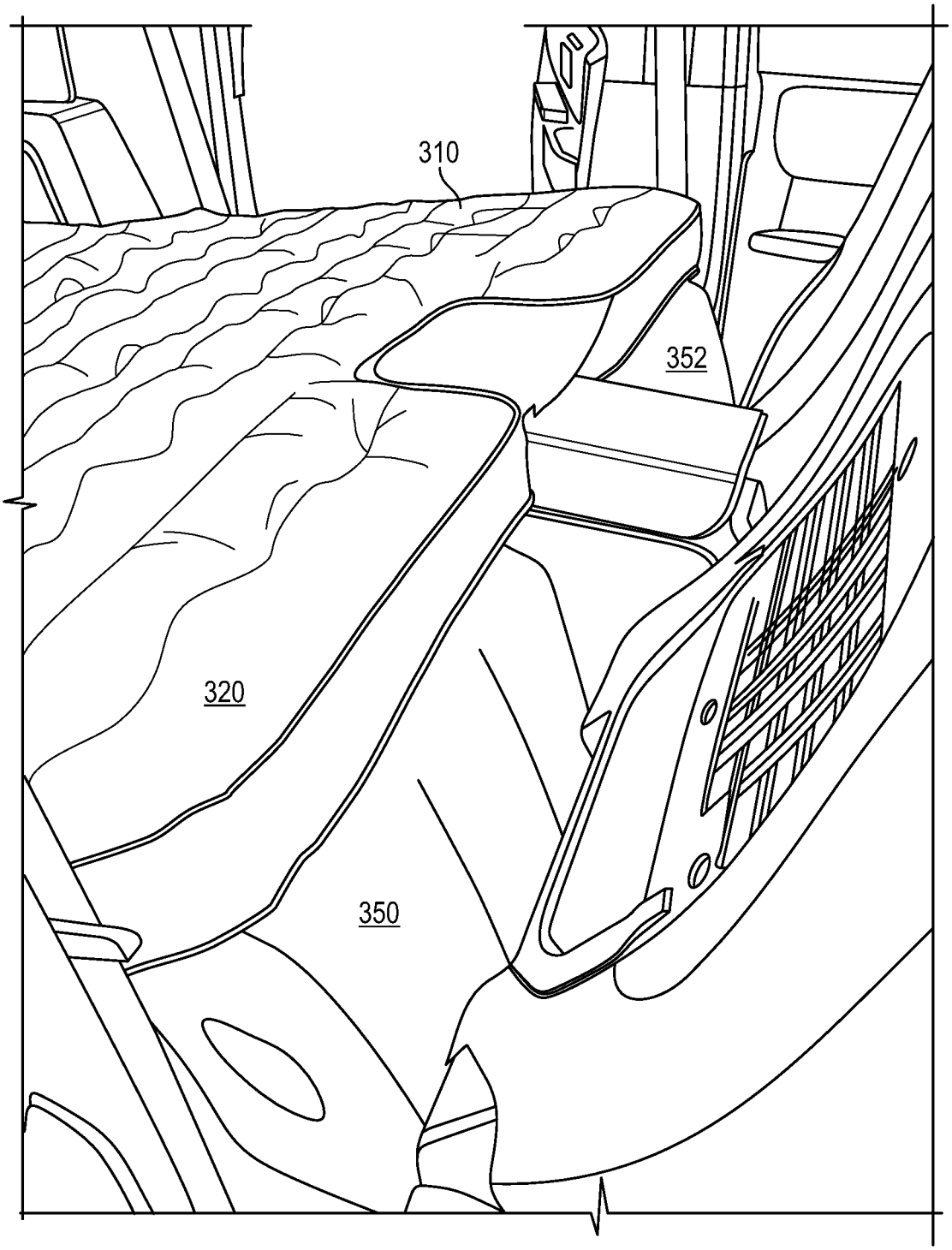
FIG. 5 is a front perspective view of the forward portion of the inflatable mattress of FIG. 4, shown as positioned within the interior space of a vehicle for usage context.
Figure 6:
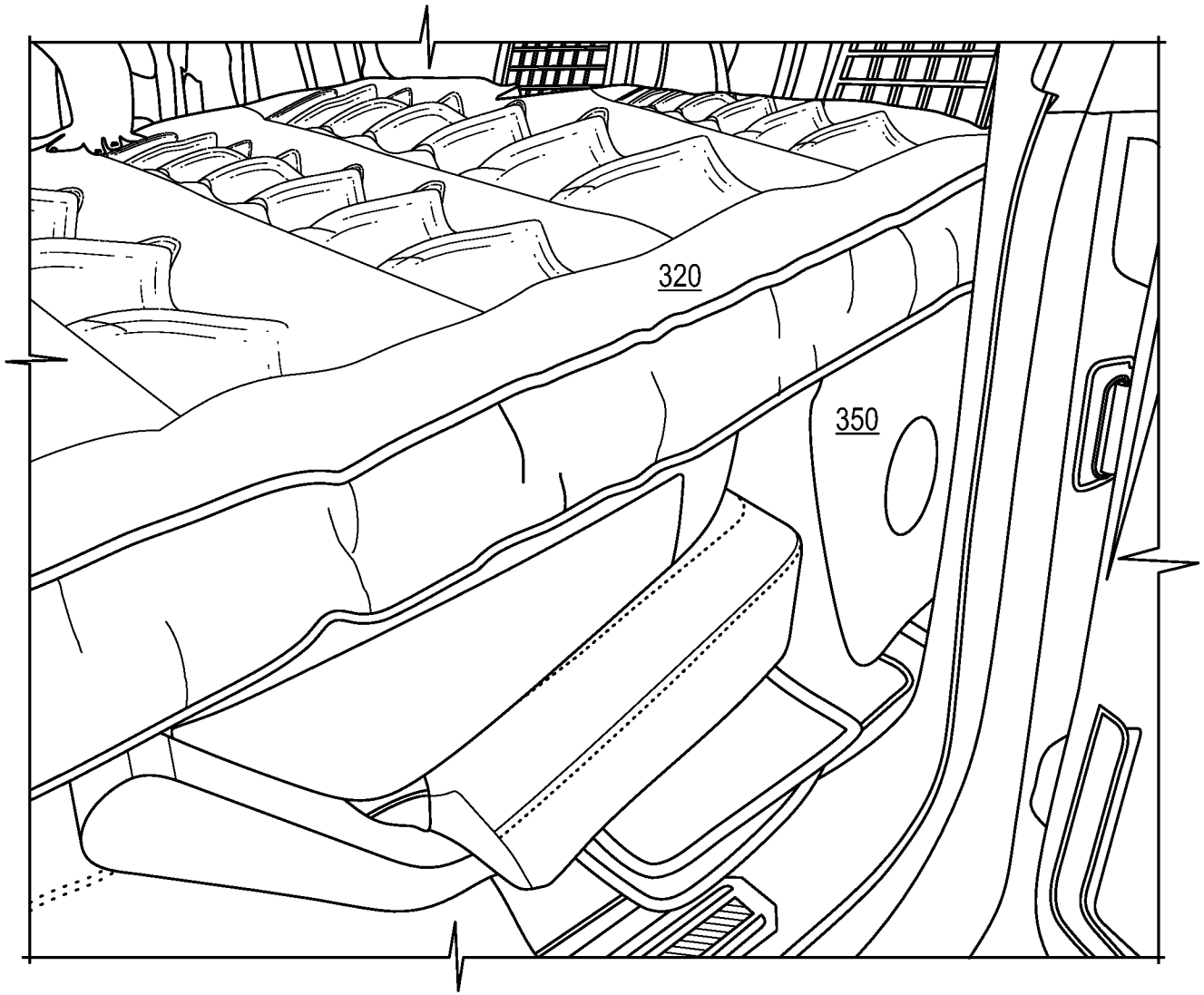
FIG. 6 is a side perspective view of the forward portion of the inflatable mattress of FIG. 4, shown as positioned within the interior space of a vehicle for usage context.

FIG. 4A depicts an inflatable mattress 300 according to another exemplary embodiment of the present invention. FIG. 4B is an underside view of a leading corner region of the inflatable mattress 300. FIG. 5 is a front perspective view of the forward portion of the exemplary inflatable mattress 300, shown as positioned within the interior space of a vehicle for usage context. FIG. 6 is a side perspective view of the forward portion of the inflatable mattress 300, shown as positioned within the interior space of a vehicle for usage context.

Now referring to FIGS. 4A-6, the exemplary inflatable mattress 300 includes a first longitudinal chamber 310 that includes a cavity 314 that receives and stores a removable air pump that is selectively operable within the cavity 314. The exemplary inflatable mattress 300 further includes a second longitudinal chamber 320 that is independently inflatable or deflatable via a second inlet 322 disposed outside of the cavity 314.

In certain embodiments, the first and second longitudinal chambers 310, 320 may be sized to fit within a rear interior space of a sport utility vehicle. For example, the rear interior space of certain sport utility vehicles may be partially defined by a bottom having unequal first and second heights, the first height being lower than and aft of the second height, and by a floor having a third height that is lower than and forward of both the first and second heights.

For such applications, the exemplary inflatable mattress 300 may have an understep 340 (as shown in FIG. 4A) that laterally traverses the underside of the first and second longitudinal chambers 310, 320. A first thickness 362 of the inflatable mattress 300 (e.g., 8 to 12 inches) aft of the understep 340 may be greater than a second thickness 364 of the inflatable mattress 300 (e.g., 3 to 6 inches) forward of the understep 340. For example, in certain embodiments the first thickness 362 may greater than the second thickness 364 by a thickness difference in the range of 2 to 6 inches.

In certain embodiments, the inflatable mattress 300 may further include one or more inflatable forward supports 350, 352 that may be selectively inflatable independently from the first and second longitudinal chambers 310, 320, for example via additional inlets disposed outside of the cavity 314. In certain embodiments, the one or more inflatable forward supports 350, 352 are each preferably but not necessarily sized to extend vertically from the vehicle floor to abut the underside of the first and/or second longitudinal chamber 310, 320. In such embodiments the vertical thickness of the one or more inflatable forward supports 350, 352 may be in the range 15 to 20 inches. The total vertical extent of the one or more inflatable forward supports 350, 352 may be further adjusted by adjusting its amount of inflation during use.

In certain embodiments, each of the inflatable forward supports 350, 352 may be selectively attachable to a corresponding one of the first and second longitudinal chambers 310, 320, for example by a conventional hook and loop interface. Alternatively, the one or more inflatable forward supports 350, 352 may be permanently attached and inflated together with a corresponding one of the first and second longitudinal chambers 310, 320, e.g., via conventional internal ducts. In embodiments where the inflatable forward supports 350, 352 are not attached to or are detachable from the first and second longitudinal chambers 310, 320, the dimensions of each of the inflatable forward supports 350, 352 may be advantageously chosen so that their height in the vertical direction is appropriate for different vehicle applications depending upon orientation (e.g., height changes to a different desired height if rotated 90 degrees).

In certain alternative embodiments that may or may not include the inflatable forward supports 350, 352, the inflatable mattress 300 may include one or more underside-stiffened regions 390 (e.g., a forward region of the mattress 300) to enable a cantilevered end portion of the inflatable mattress 300 to support a user even where the environmental underlying support (e.g., from a supporting surface of the vehicle interior) is not directly beneath. For example, as shown in FIG. 4B, the underside-stiffened region 390 may be a forward region of the mattress 300 (e.g., a forward corner region) comprising one or more stiffening inserts 392 (e.g., comprising metal, plastic, or a composite material such as fiberglass or carbon fiber reinforced epoxy) that are slidably insertable and removable within one or more sewn fabric pockets 394 (e.g., optionally but not necessarily oriented longitudinally) in the underside of the mattress 300.

In certain embodiments, the underside-stiffened region 390 may not underly an entire width of the leading region of the inflatable mattress 300, but rather may be included only in the portion(s) of the leading region of the inflatable mattress 300 that may expected to be cantilevered in particular vehicle interior applications. Limiting the length of the underside-stiffened region 390 to less than $\frac{1}{3}^{rd}$ of the total length of the mattress 300, or providing removability by securing the stiffening inserts 392 to the inflatable mattress 300 with tight but open-ended corresponding fabric pockets 394 (e.g., sized to allow the stiffening inserts to be removable by sliding), may improve the subsequent foldability of the inflatable mattress 300 when not in use according to certain embodiments.

Figure 7:
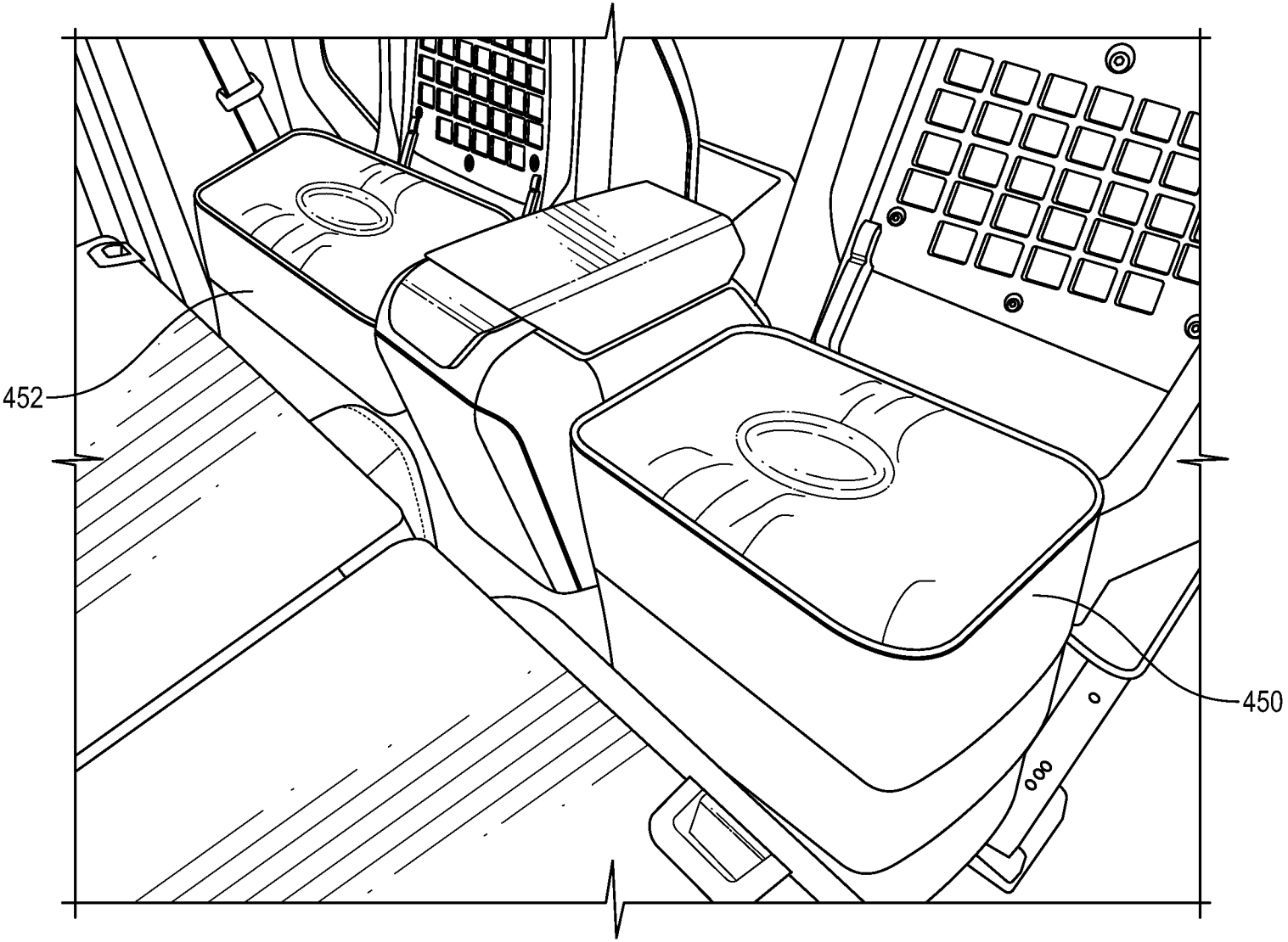
FIG. 7 depicts two inflatable forward supports of an inflatable mattress according to an exemplary embodiment of the present invention, shown as positioned within the interior space of a vehicle for usage context.

FIG. 7 depicts two separate inflatable forward supports 450, 452 of an inflatable mattress according to another exemplary embodiment of the present invention, shown as positioned within the interior space of a vehicle, e.g., behind the vehicle's front seats, for usage context.

Figure 8:
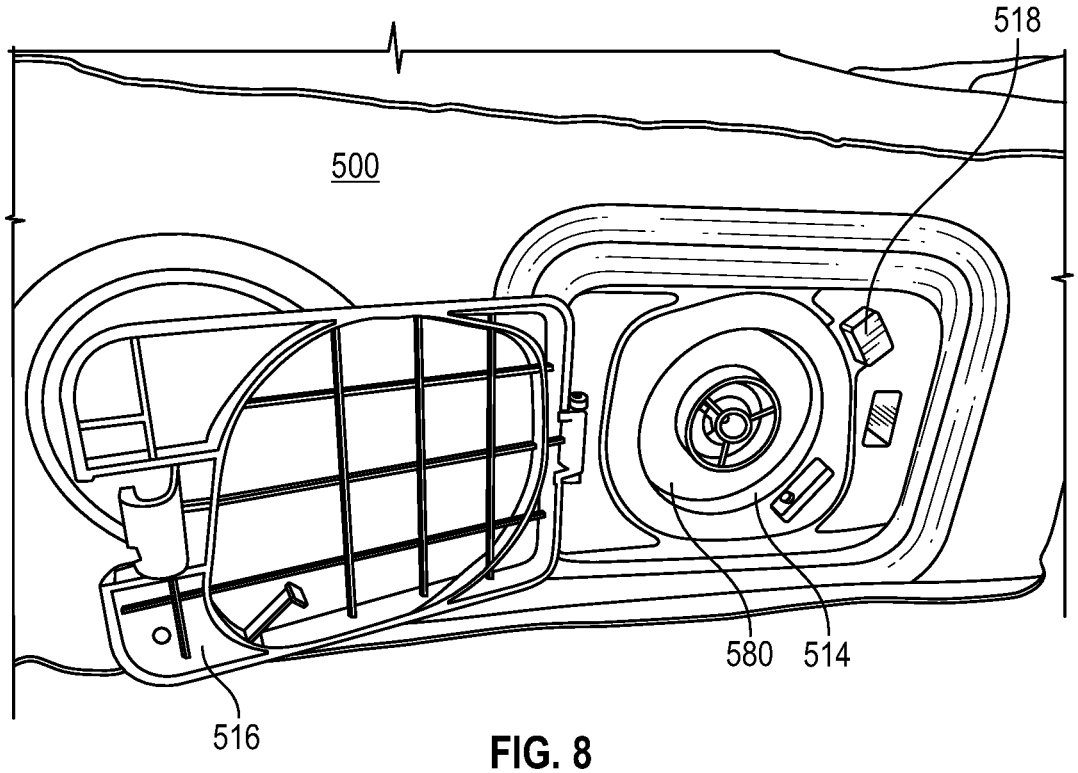
FIG. 8 depicts a removable air pump within a pump cavity of the aft end of an inflatable mattress according to an exemplary embodiment of the present invention.
Figure 9:
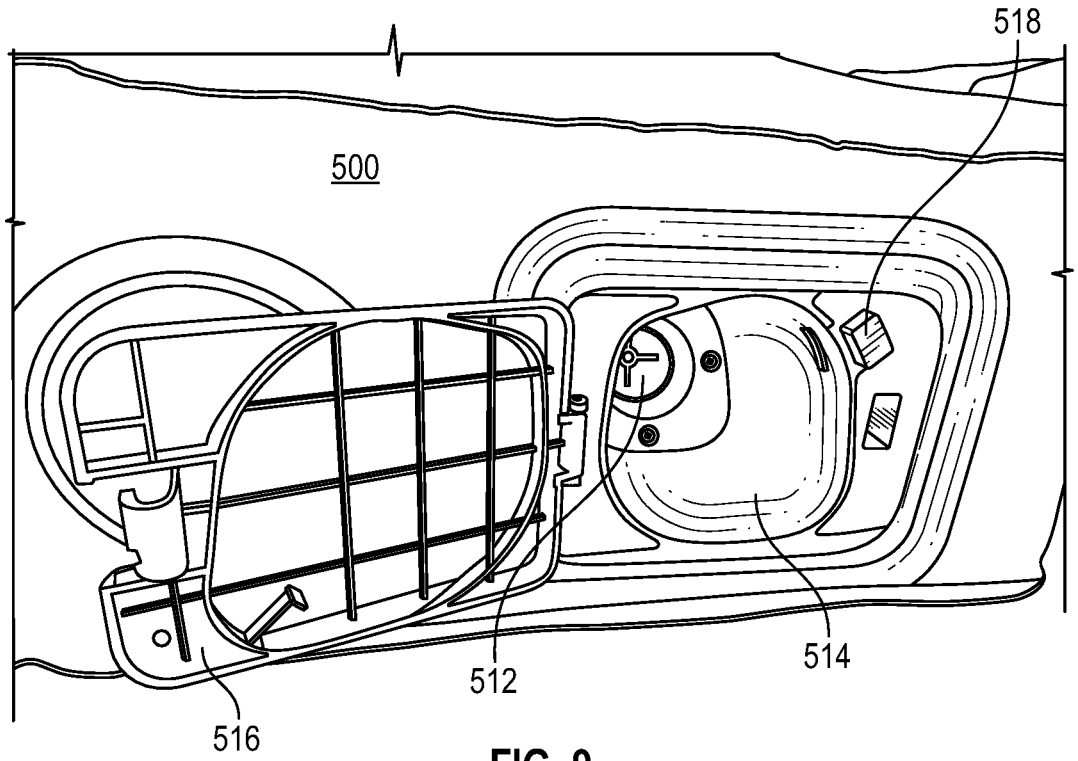
FIG. 9 depicts a pump cavity of the aft end of an inflatable mattress according to an exemplary embodiment of the present invention.

FIG. 8 depicts a removable air pump 580 within a pump cavity 514 of the aft end of an inflatable mattress 500, according to an exemplary embodiment of the present invention. FIG. 9 depicts the pump cavity 514 with the air pump removed. The pump cavity 514 is visible in FIGS. 8-9 because an optional pump cavity door 516 is shown in an open position; otherwise the pump cavity 514 would be covered from view. It is contemplated herein that the pump cavity door 516 optionally could be omitted entirely from the mattress design in certain alternative embodiments. Again referring to the exemplary embodiment of FIGS. 8-9, the pump cavity 514 preferably includes a first inlet 512 that is adapted to mate with an outlet of the removable air pump 580 within the cavity 514 for ready inflation (e.g., of a longitudinal chamber of the inflatable mattress 500) without removal of the air pump 580 from the cavity 514.

The aft end of the inflatable mattress 500 may also optionally include an air pump ejection mechanism, for example including an air pump ejection button 518, that mechanically releases the air pump 580 from a conventional internal latch that otherwise prevents removal of the air pump 580. In the embodiment of FIGS. 8-9, the air pump ejection button 518 is optionally disposed in a location where it is covered by the pump cavity door 516 when closed, for example to prevent accidental or unintended actuation of the air pump ejection button 518.

Figure 10A:
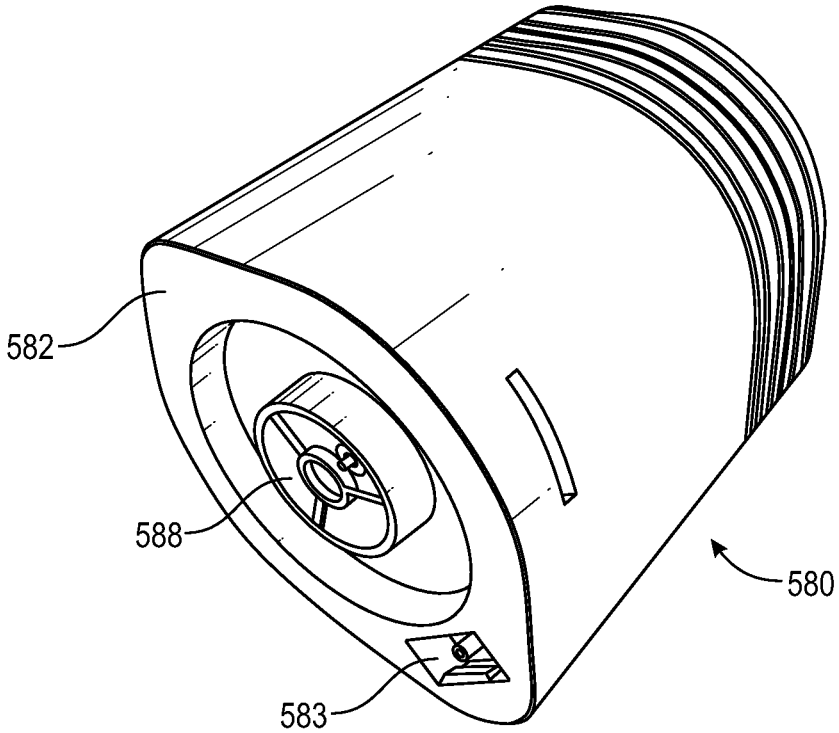
FIG. 10A is a perspective view of the aft face of a removable air pump according to an exemplary embodiment of the present invention.
Figure 10B:
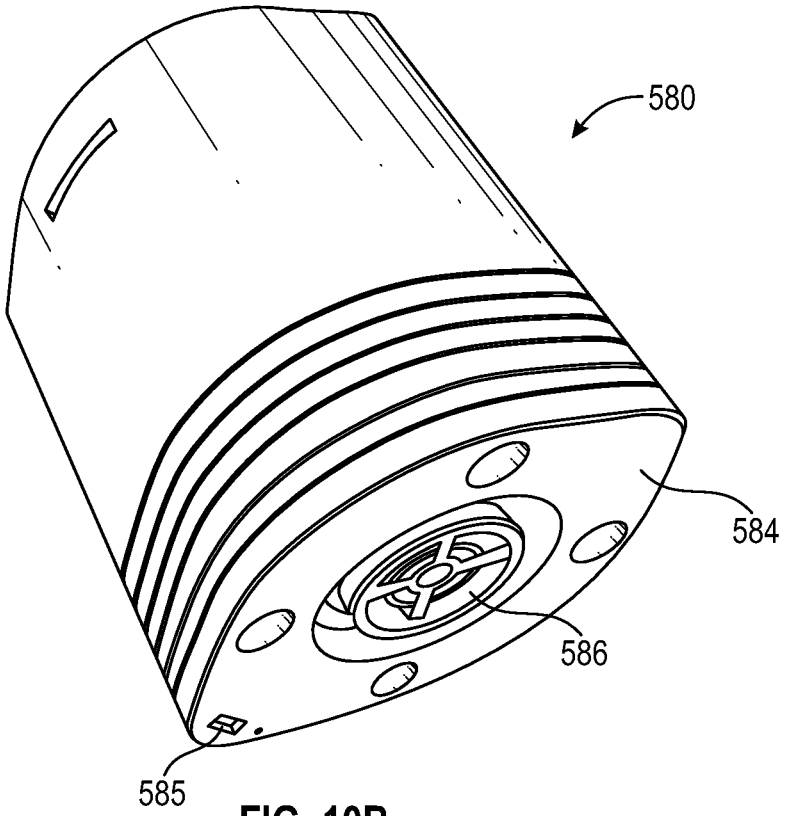
FIG. 10B depicts the removable air pump of FIG. 10A from a different perspective from which its insertable end is visible.

FIG. 10A depicts the removable air pump 580 according to an exemplary embodiment of the present invention, from a perspective from which its aft face 582 is visible. FIG. 10B is a perspective view of the insertable end 584 of the removable air pump 580. In the embodiment of FIGS. 10A-10B, the aft face 582 of the removable air pump optionally includes a pumping control switch 583, for example a conventional sliding or rocking switch to initiate, terminate, or reverse air pumping for inflation or deflation. The insertable end 584 of the removable air pump 580 is shown in FIG. 10B to optionally include a conventional charging port 585 for a conventional rechargeable battery (internal and not shown).

Now referring to FIGS. 8-10B, the removable air pump 580 preferably includes a pump outlet 586 that is located to mate with the first inlet 512 within the cavity 514 for inflation without removal of the air pump 580 from the cavity 514. The removable air pump 580 preferably also includes a pump inlet 588 to enable air to flow through the removable air pump 580 during inflation operation. The roles of the pump outlet 586 and pump inlet 588 may be reversed if the pump is optionally used for deflation operation. The pump outlet 586 is considered to "mate" with the first inlet 512 if an outflow from the pump outlet 586 is able to enter the first inlet 512 within the cavity 514 for mattress inflation.

In certain embodiments, the inflatable mattress 500 may include a conventional door switch that is actuated when the pump cavity door 516 is opened or closed. For example, such a door switch may be disposed within a hinge or latch of the pump cavity door 516, or may be actuated by a conventional plunger attached to the pump cavity door 516. In certain preferred embodiments, the door switch may be wired so that when the pumping control switch 583 is on, the pump 580 will operate when the pump cavity door 516 is open, but will turn off when the pump cavity door 516 is closed and blocking air flow. In such embodiments, the pump cavity door switch may advantageously protect the pump 580 from futilely attempting to pump air through the pump cavity door 516 when it is closed.

Figure 11:
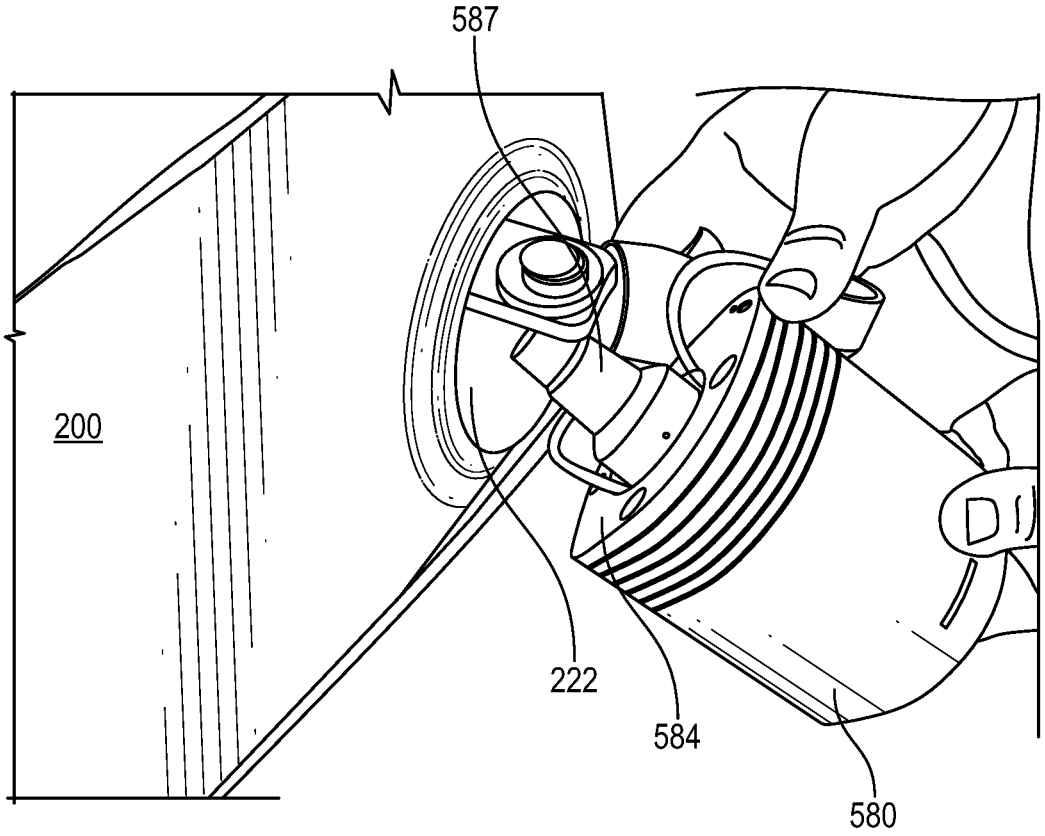
FIG. 11 depicts use of the removable air pump to inflate the second inlet of a second inflatable chamber, according to an exemplary embodiment of the present invention.

FIG. 11 depicts the optional use of the removable air pump 580 with a removable nozzle attachment 587, according to an exemplary embodiment of the present invention, to inflate a separately-inflatable mattress chamber like the second inflatable chamber 220 of the inflatable mattress 200 of FIG. 3, via its second inlet 222.

In the foregoing specification, the invention is described with reference to specific exemplary embodiments thereof, but those skilled in the art will recognize that the invention is not limited thereto. It is contemplated that various features and aspects of the above-described invention may be used individually or jointly and possibly in an environment or application beyond those described herein. The specification and drawings are, accordingly, to be regarded as illustrative and exemplary rather than restrictive. The terms "comprising," "including," and "having," as used herein are intended to be read as open-ended terms.

I claim:

1. An inflatable mattress for use in a vehicle, the inflatable mattress comprising:

a removable air pump;

a first longitudinal chamber that includes a pump cavity that receives and stores the removable air pump, the pump cavity including a first inlet that is adapted to mate with an outlet of the removable air pump within the cavity for ready inflation of the first longitudinal chamber without removal of the air pump from the cavity, a second independently-inflatable longitudinal chamber, the second longitudinal chamber comprising a second inlet configured to mate with the outlet of the removable air pump at a second inlet location that is disposed outside of the cavity.

2. The inflatable mattress of claim 1 wherein the removable air pump includes a rechargeable battery and a charging port.

3. The inflatable mattress of claim 1 wherein a leading region of at least one of the first and second longitudinal chambers includes one or more underside stiffener inserts that enable the leading region to be cantilevered without directly-underlying support from the vehicle.

4. The inflatable mattress of claim 3, wherein the leading region of each of the first and second longitudinal chambers includes one or more underside pockets that receive the stiffener inserts.

5. The inflatable mattress of claim 4 wherein the first longitudinal chamber and the second longitudinal chamber define a total length, and the leading region has an underside-stiffened length that spans the one or more underside pockets and underside stiffener inserts and that is less than one-third of the total length.

6. The inflatable mattress of claim 1 wherein the width of the first longitudinal chamber is greater than the width of the second longitudinal chamber by a width difference in the range of 10 to 14 inches.

7. The inflatable mattress of claim 1 wherein the first and second longitudinal chambers comprise an understep that laterally traverses their underside, a first thickness of the first and second longitudinal chambers aft of the understep being greater than a second thickness of the first and second longitudinal chambers forward of the understep.

8. The inflatable vehicle mattress of claim 7 wherein the first thickness is greater than the second thickness by a thickness difference in the range of 2 to 6 inches.

9. The inflatable mattress of claim 1 wherein the pump cavity and the second inlet are disposed at an aft end of the inflatable mattress.

10. The inflatable mattress of claim 1 wherein an aft face of the removable air pump includes a pumping control switch.

11. The inflatable mattress of claim 1 further comprising at least one inflatable forward support, wherein the at least one inflatable forward support is selectively inflatable independently from the first and second longitudinal chambers.

12. The inflatable mattress of claim 11 wherein the first and second longitudinal chambers are sized to fit within a rear interior space of a sport utility vehicle, the rear interior space being partially defined by a bottom having unequal first and second heights, the first height being lower than and aft of the second height, and by a floor having a third height that is lower than and forward of both the first and second heights, the at least one inflatable forward support being sized to extend vertically from the floor to at least one of the first and second longitudinal chambers.

13. The inflatable mattress of claim 11 wherein the inflatable mattress further comprises an understep that laterally traverses the underside of the first and second longitudinal chambers, a first thickness of the first and second longitudinal chambers aft of the understep being greater than a second thickness of the first and second longitudinal chambers forward of the understep, and the at least one inflatable forward support defines a third thickness that is greater than the first thickness and the second thickness.

14. The inflatable mattress of claim 13 wherein the third thickness is in the range of 15 to 20 inches.

15. The inflatable mattress of claim 11 wherein the at least one inflatable forward support is selectively attachable to at least one of the first and second longitudinal chambers.

16. The inflatable mattress of claim 11 wherein the at least one inflatable forward support abuts at least one of the first and second longitudinal chambers.

17. The inflatable mattress of claim 1 wherein the first and second longitudinal chambers are joined along a flexible longitudinal seam that is disposed between the first and second longitudinal chambers.

18. The inflatable mattress of claim 17 wherein the flexible longitudinal seam extends laterally from top surfaces of the first and second longitudinal chambers.

19. The inflatable mattress of claim 17 wherein the flexible longitudinal seam includes a longitudinal zipper and the first and second longitudinal chambers are selectively joined and separable by the longitudinal zipper.

20. The inflatable mattress of claim 19 wherein the longitudinal zipper includes a top cover that comprises a fabric flap.

* * * * *